United States Patent [19]

Matsuo et al.

[11] Patent Number: 4,587,502

[45] Date of Patent: May 6, 1986

[54] ELECTROMAGNETIC RELAY

[75] Inventors: Kenichi Matsuo; Muneo Nakata, both of Iida, Japan

[73] Assignee: Omron Tateisi Electronics Co., Kyoto, Japan

[21] Appl. No.: 603,013

[22] Filed: Apr. 23, 1984

[30] Foreign Application Priority Data

Apr. 23, 1983 [JP] Japan ..... 58-61341[U]
Apr. 23, 1983 [JP] Japan ..... 58-61343[U]

[51] Int. Cl.[4] ..... H01H 51/22

[52] U.S. Cl. ..... 335/85; 335/78; 335/202

[58] Field of Search ..... 335/78–85, 335/229, 330, 174, 175

[56] References Cited

U.S. PATENT DOCUMENTS

| | | | |
|---|---|---|---|
| 2,832,867 | 4/1958 | Luhn | 335/79 |
| 3,100,825 | 8/1963 | Wales | 335/80 |
| 3,946,347 | 3/1976 | Sauer | 335/202 |
| 3,993,971 | 11/1976 | Ono et al. | 335/78 |

*Primary Examiner*—Harold Broome
*Attorney, Agent, or Firm*—Schwartz, Jeffery, Schwaab, Mack, Blumenthal & Evans

[57] ABSTRACT

An electromagnetic relay comprising an electromagnet constituted by an I-like core and a coil wound around the core, a pair of contact mechanisms disposed at both sides of the electromagnet, respectively, a pair of permanent magnets disposed in parallel with the core in such magnetic orientation that the magnetic poles of the permanent magnets each positioned adjacent to each lateral end faces of the I-like core exhibit different polarities, the permanent magnets being interconnected by connecting beam members at both ends to thereby constitutes a frame-like movable armature, a H-like holder having four upstanding legs positioned in opposition to the lateral end faces of the I-like core, respectively, with the permanent magnet being interposed between the legs and the core, actuating members operatively coupled to the permanent magnetic for actuating the contact mechanisms in response to the movement of the armature frame, and a restorting spring for the movable armature frame.

11 Claims, 21 Drawing Figures

ELECTROMAGNETIC RELAY

BACKGROUND OF THE INVENTION

1. Field of the Invention

The present invention relates to an improvement on or relating to an electromagnetic relay of the type in which relay contacts are actuated by a movable armature in response to energization and deenergization of an electromagnetic coil wound on an iron core.

2. Description of the Prior-Art

Heretofore, there has been known an electromagnetic relay in which a movable armature is rotated under the magnetic force produced by an electromagnet to thereby switch or change over a contact mechanism. This type relay, however, suffers from various drawbacks. For example, the magnetic force produced by the electromagnet is not utilized effectively but undergoes considerable loss. It is difficult to realize the smooth operation in the balanced state.

Further, in the electromagnetic relay, the contact mechanism is acommodated within a space defined by an electrically conductive layer which is connected to the ground with a view to attaining high electrical isolation and improving the high-frequency characteristics. More specifically, a room for accommodating the contact mechanism is formed in a molded synthetic resin block defining the contact accommodating room being coated with an electrically conductive layer through plating, evaporation or the like process.

The metallized projections are used as the earth terminals to which lead wires are soldered when the relay is mounted on a substrate for a printed circuit. In the soldering process, molten solder material heated at ca. 260° C. remains in contact with the metallized projections for about ten seconds. In case the solder material is heated at 350° C., the contacting duration will be about five seconds. Accordingly, if the base provided with the terminal projections is formed of a conventional inexpensive resin material which is likely to undergo thermal deformation at a relatively low temperature, the resin material is easily thermally expanded (bulging) or fluidized to rupture the metal layer, eventually involving destruction of the earth terminal.

As an approach to dispose of the difficulty mentioned above, there is known a proposal illustrated in FIG. 1 of the accompanying drawings. Referring to the figure, a numeral 60 denotes a base made of a synthetic resin, 61 denotes a projection formed integrally with the base 60 and used for the earth terminal, and 62 denotes an electrically conductive film deposited on the base 60 and the projection 61 through plating with a sub-layer 63 being interposed.

In the structure shown in FIG. 1, a depression 64 is formed in the bottom end of the projection 61. This depression 64 is not coated thick with the electrically conductive layer 62 in an attempt to allow the resin material to expand or be fluidized at this portion 64, for thereby preventing the metallic layer 62 from being ruptured. However, in practice, when the earth terminal 65 is to be implemented thin such that the foot portion of the projection 61 is, for example, on the order of 0.8 mm in diameter with the top being ca. 0.3 mm before metallization, the finished cylindrical earth terminal of ca. 0.9 mm in diameter tends to be deposited with an increased amount of electrically conductive material at the tip 61. In other words, a great difficulty is encountered in realizing the depression 64 in the tip of the projection 61 in the manner shown in FIG. 1, which in turn means that it is difficult to positively protect the earth terminal 65 from destruction when it is heated upon soldering which results in, to a serious disadvantage.

As another attempt to solve the above problem, there is conceivable a method illustrated in FIGS. 2(A) and 2(B). More specifically, the free end portion 67 of the earth terminal 65 is cut away along a broken line 68, for preventing the rupture of the electrically conductive layer 62. In that case, however, drops of the molten resin material will contaminate other parts of the relay. Besides, the cutting requires an additional time consuming process.

Furthermore, in the hitherto known electromagnetic relay, the assemblying of the electromagnet and a core frame on a base requires a troublesome and time consuming procedure. For example, the core frame is first secured to the coil spool of the electromagnet by rivetting and subsequently depending projections formed in collars of the spool are fitted in the apertures formed in the base to be fixedly secured to the base by thermal rivetting or by using a bonding agent, requiring thus at least two assembling steps.

SUMMARY OF THE INVENTION

It is an object of the present invention to provide an electromagnetic relay which can change over two circuits to mutually opposite states, respectively, and in which the contacting pressure of movable contact members or arms is increased in a simple structure.

Another object of the present invention is to provide an electro-magnetic relay of a novel and improved structure which is substantially immune to the drawbacks of the conventional electromagnetic relays described above and in which the magnetic force can be effectively utilized without appreciable loss and operation of the relay effected smoothly in a balanced state.

Still another object of the invention is to provide an electromagnetic relay in which an electromagnet, a holder frame and a base are so constructed that they can be secured together through a single assembling step.

A further object of the invention is to provide an electromagnetic relay in which destruction of the earth terminal due to bulging and/or fluidization of a synthetic resin possibly brought about by soldering of a lead wire is positively prevented, while protecting constituent parts of the relay from contamination by the fluidized resin material and rendering it unnecessary to cut away the tip portion of the earth terminal.

In view of the objects described above, there is provided according to a general aspect of the present invention an electromagnetic relay which comprises an electromagnet composed of a bar-like core and a coil wound around the core, at least a contact mechanism disposed at a side of the electromagnet, a movable armature composed of at least a permanent magnet juxtaposed in parallel with the electromagnet so that both magnetic poles of the permanent magnet are positioned in opposition to both ends of the iron core, respectively, a support or holder frame having erect legs positioned adjacent to both ends of the core, respectively, with the permanent magnet being interposed between the legs and the core, an actuating member operatively coupled to the permanent magnet for actuating the contact mechanism, and a restoring spring for the movable armature disposed between the permanent magnet and the core.

In a first preferred embodiment of the electromagnetic relay, the core is realized in an I-like configuration and pairs of relay switches or contacts are disposed at both sides of the electromagnet, respectively, with a first pair of the relay switches being positioned adjacent to one end of the core while a second pair of the relay switches is positioned adjacent to the other end of the core. The armature is of a rectangular frame structure constituted by a pair of permanent magnets disposed in parallel with the core at both sides thereof and interconnected by non-magnetic connecting beams, wherein the pair of permanent magnets are so disposed that magnetic poles of opposite polarities face toward one another. The holder frame is realized in an H-like form having four upstanding legs of which two are disposed at one side of the electromagnet with the one permanent magnet being interposed therebetween while the other two legs are disposed at the other side of the electromagnet with the other permanent magnet being disposed therebetween, so that each leg faces each of lateral end faces of the I-like core.

By virtue of the structure of the electromagnetic relay described above, the pair of relay switches or contact mechanisms disposed at each side of the electromagnet can be concurrently actuated in the same or different directions by parallel movement or translation of the movable armature frame including the pair of permanent magnets. Since the driving power produced by the magnetic circuit formed by the permanent magnets and the electromagnet is imparted to the movable contacts constituting parts of the contact mechanisms or relay switches in the direction perpendicular to the longitudinal axis of the movable contact arm, the magnetic force is utilized most effectively with loss of the magnetism or natural demagnetization being reduced to a minimum. Further, the pairs of the contact mechanisms disposed at both sides of the electromagnet/armature assembly can be actuated smoothly in a balanced state by means of the rectangular armature frame including the pair of parallel permanent magnets.

In a second preferred embodiment of the invention, end collars of a spool wound with the coil which constitutes the electromagnet in cooperation with the core are disposed on the bottom of a box-like base with the holder frame being interposed between the bottom and the electromagnet. By pouring a bonding agent in through-holes or apertures formed in the bottom of the base at appropriate positions, the end collars of the spool, the base and the holder frame are fixedly secured to one another. In other words, the electromagnet, the holder frame and the base can be fixedly connected together by the bonding agent at a single step, whereby the efficiency of the assembling can be significantly increased.

In the electromagnetic relay according to a third preferred embodiment of the invention, the box-like base for accommodating the contact mechanism is formed of a synthetic resin integrally with earth projections extending outwardly from the bottom wall of the base, wherein an electrically conductive layer for earth connection of the contact mechanism is deposited over the whole surface of the box-like base inclusive of that of the earth projections. A blind bore is formed longitudinally in each of the projections. With this structure, expansion or bulging or fluidization of the synthetic resin upon soldering a lead wire on the metallized projection serving for the earth terminal can be accommodated by the longitudinal bore, whereby rupture of the metallic layer of the earth terminal due to the heating for soldering can be positively prevented. Furthermore, parts of the relay are protected from contamination with the fluidized drops of the resin material. Moreover, the time consuming process for cutting the tip portion of the earth terminal or projection can be spared.

According to a fourth preferred embodiment of the invention, the electromagnetic relay comprises a common contact member, a normally closed contact member, a normally opened contact member provided in opposition to the normally closed contact member with the common contact being interposed therebetween, a normally closed movable contact arm mounted on a card at an intermediate portion and serving for opening or closing a current path between the common contact member and the normally closed member, a normally opened movable contact arm mounted on a card at an intermediate portion and serving for closing or opening a current path between the common contact member and the normally opened contact member, a restoring spring for resiliently urging the cards in parallel with each other to thereby hold the normally closed movable contact arm in the current path establishing or closing state while holding the normally opened movable contact arm in the current path interrupting or opening state, an electromagnet for pressing the restoring spring at an intermediate portion to thereby change over the normally closed contact arm to the current path opening state while changing over the normally opened movable contact to the current path closing state, and a pair of earth protrusions against which at least the normally closed movable contact arm bears on in the current path opening state of the normally closed movable contact wherein the distance between the paired earth protrusions against which the normally closed movable contact arm bears is selected smaller than a distance between the common contact member and the normally opened contact member.

With the structure of the electromagnetic relay described above, elastic deformation of the normally closed movable contact arm pressed against the pair of the earth protrusions is reduced, whereby the normally closed movable contact arm can bear against the earth protrusions with a correspondingly increased contacting force. As the consequence, the normally opened movable contact arm which is actuated concurrently with the normally closed movable contact arm can be pressed against the common contact member and the normally opened contact member with an equally increased contacting force. Thus, an increased contacting force of the normally opened movable contact arm can be obtained without decreasing the distance between the common contact member and the normally opened contact member, which would otherwise produce an undesirable electrostatic coupling for high frequency current components.

BRIEF DESCRIPTION OF THE DRAWINGS

The above and other objects, features and advantage of the present invention will become readily apparent upon consideration of the following detailed description of the preferred embodiments made with reference to the accompanying drawings, in which.

DESCRIPTION OF THE PREFERRED EMBODIMENTS

Figure 1:
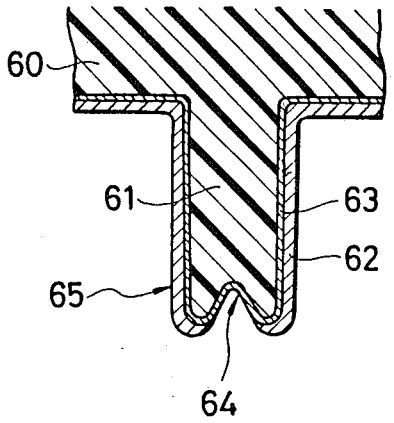
FIG.1 PRIOR ART
FIG. 1 is a fragmental sectional view showing a structure of an earth terminal used in hitherto known electromagnetic relays.
Figure 2A:
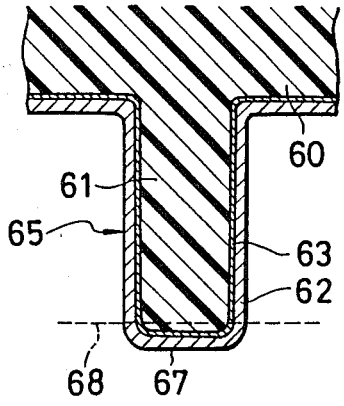
FIG.2(A) PRIOR ART
FIGS. 2(A) and 2(B) are fragmental sectional views showing a structure of an earth terminal used in hitherto known electromagnetic relays, respectively, in states before and after the tip portion of the earth terminal is cut away.
Figure 2B:
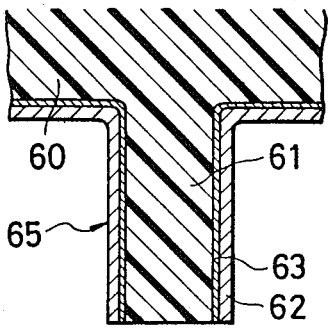
FIG.2(B) PRIOR ART

Now, the invention will be described in detail in conjunction with exemplary embodiments by referring to the drawings.

Figure 3:
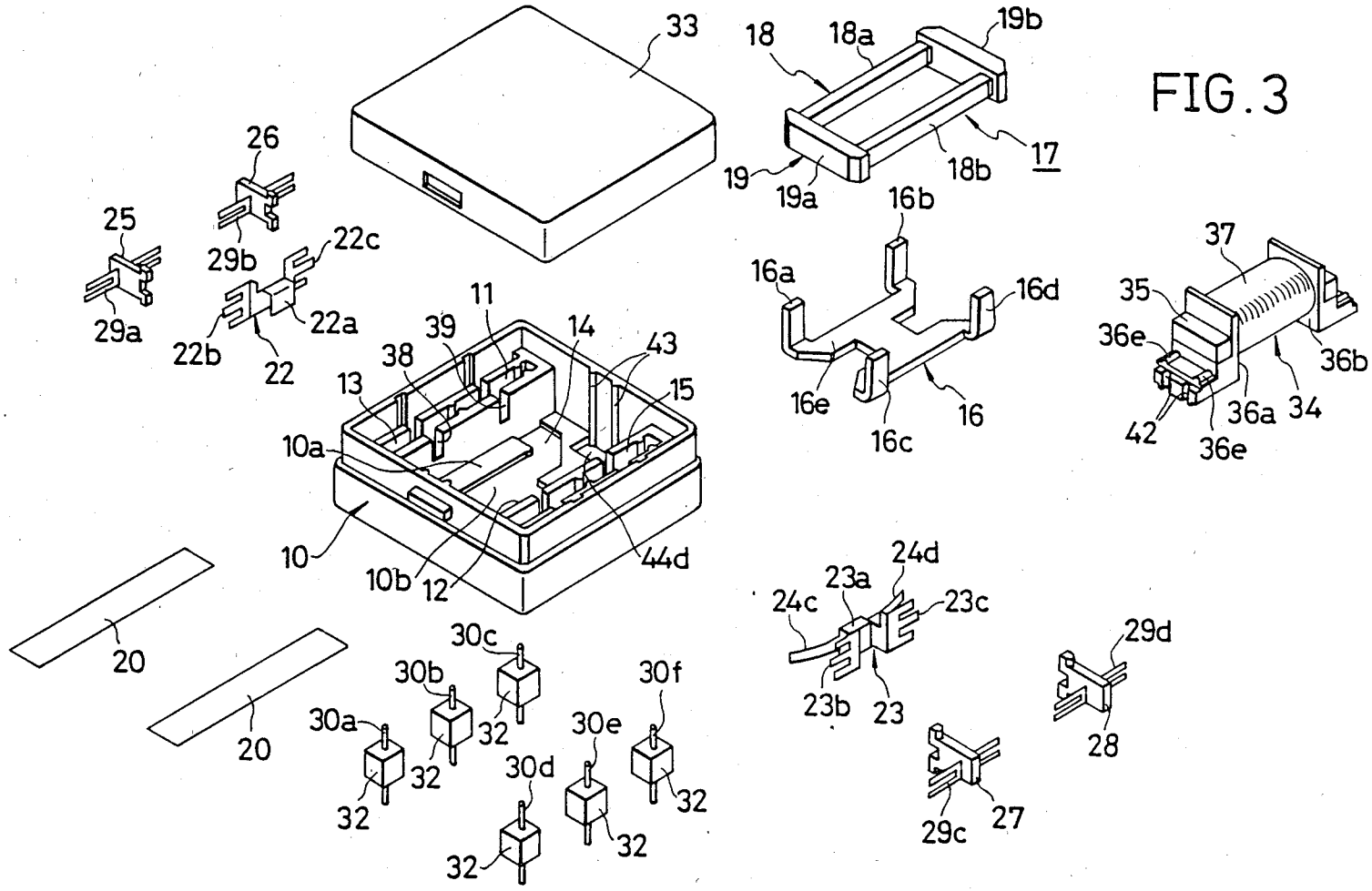
FIG. 3 is an exploded perspective view showing an electromagnetic relay according to an exemplary embodiment of the present invention.

FIG. 3 shows an exploded perspective view an electric power according to an exemplary embodiment of the present invention. Referring to FIG. 3, a reference numeral 10 denotes a box-like base which is made of synthetic resin and has the interior spaced partitioned into three compartments or recesses 13, 14 and 15 by means of a pair of partition walls 11 and 12. A reference numeral 16 generally denotes an holder frame composed of a H-like base or bottom plate **16*e* and four erect legs 16*a*, 16*b*, 16*c* and 16*d* formed at four ends of the H-like base 16*e*. A numeral 17 denotes a movable armature frame of a rectangular form which is constituted by a pair of permanent magnets 18*a* and 18*b* disposed in parallel with each other in such an orientation that different magnetic poles (N and S) appearing at both ends of the permanent magnets are, respectively, in opposition to each other (refer to FIG. 4), and a pair of connecting beam members 19*a* and 19*b* for interconnecting both the permanent magnets 18*a* and 18*b* at both ends thereof. The connecting members 19*a* and 19*b* are formed of a non-magnetic material. Reference numerals 20 and 20' denote shielding plates. Numerals 22 and 23 denote actuator members which are made of a non-magnetic material and constituted, respectively, by clamping portions 22*a* and 23*a* each of a substantially C-like cross section. The clamping portion 22*a* is integrally formed with a pair of E-like lateral latch members 22*b* and 22*c*. Similarly, the clamping portion 23*a* is also integrally formed with a pair of E-like latch members 23*b* and 23*c*, and additionally has a pair of restoring leaf springs 24*c* and 24*d* formed integrally. Numerals 25, 26, 27 and 28 denote cards which are made of a synthetic resin and serve for supporting movable contact pieces 29*a*, 29*b*, 29*c* and 29*d* at mid portions thereof, respectively. Stationary contact members denoted by 30*a*, 30*b*, 30*c*, 30*d*, 30*e* and 30*f* are supported by respective dielectric supporting blocks 32. A reference numeral 33 denotes a cover of synthetic resin adapted to close the open top end of the box-like base 10, and 34** generally designates an electromagnet.

Figure 4:
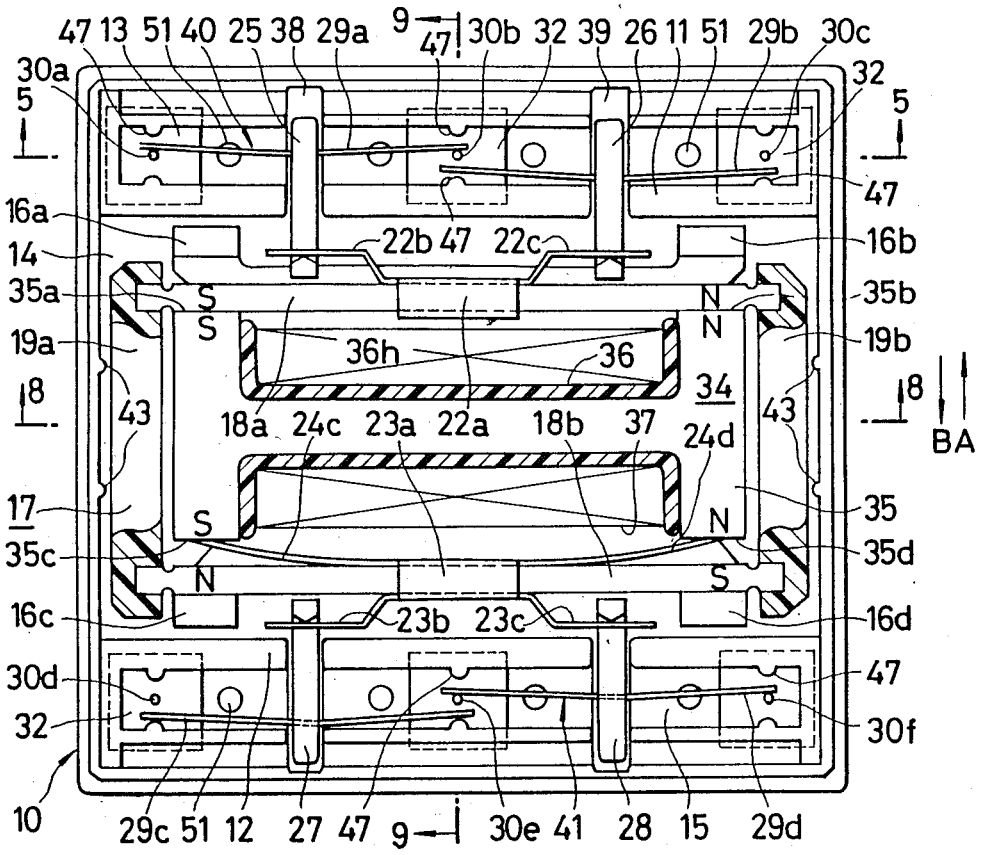
FIG. 4 is a partially broken plan view showing the assembled state of the electromagnetic relay shown in FIG. 3.
Figure 5:
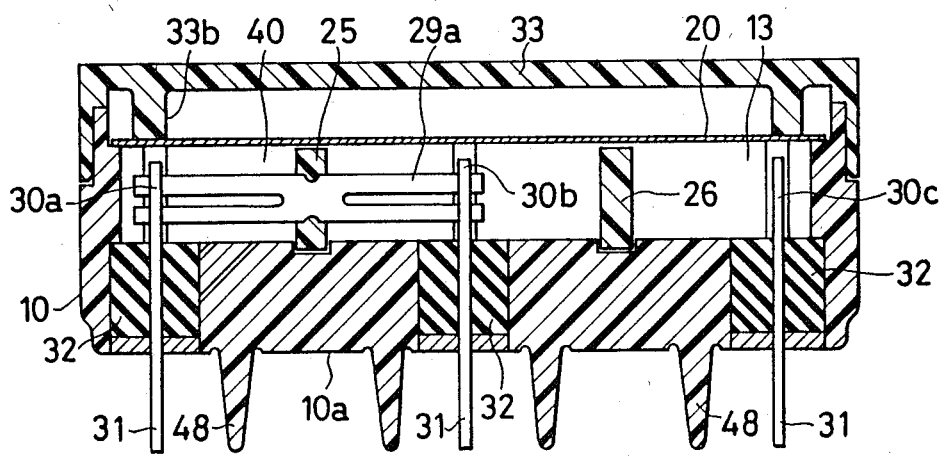
FIG. 5 is a sectional view taken along the line 5—5 in FIG. 4.

FIG. 4 shows in a partially broken plan view the electromagnetic relay in the assembled state. As can be seen, the electromagnet 34 is composed of a generally I-like iron core 35 having an intermediate portion wound with a coil 37 with interposition of a sleeve **36*h* of a spool 36 formed of a synthetic resin. The cards 25 and 26 are placed, respectively, in guide grooves 38 and 39 formed in the partition walls 11 of the box-like base 10. As is shown in FIG. 5 which is a sectional view taken along the line 5—5 in FIG. 4, the pin-like stationary contact members 30*a*, 30*b* and 30*c* are supported on the bottom of the recess 13 of the box-like base 10 by means of the respective dielectric blocks 32. It will be seen in FIG. 4 and FIG. 5 that the movable contact member 29*a* is disposed within the recess 13 so that it can open or close the normally closed stationary contact member 30*a* and the common stationary contact member 30*b*. On the other hand, the movable contact member 29*b* is disposed within the recess 13 to be switchable between the common stationary contact member 30*b* and the normally open stationary contact member 30*c*. These three stationary contact members 30*a*, 30*b* and 30*c* cooperate with the movable contact members 29*a* and 29*b* to constitute the contact mechanism 40. The other movable contact members 29*c* and 29*d* and stationary contact members 30*d*, 30*e* and 30*f* are disposed within the recess 15 located in opposition to the recess 13 means of the cards 27 and 28 and the dielectric blocks 32 in the similar manner, wherein the movable contact members 29*c* and 29*d* cooperate with the stationary contact members 30*d*, 30*e* and 30*f* to constitute a contact mechanism generally denoted by 41 of the structure similar to the contact mechanism 40** mentioned above.

Figure 6:
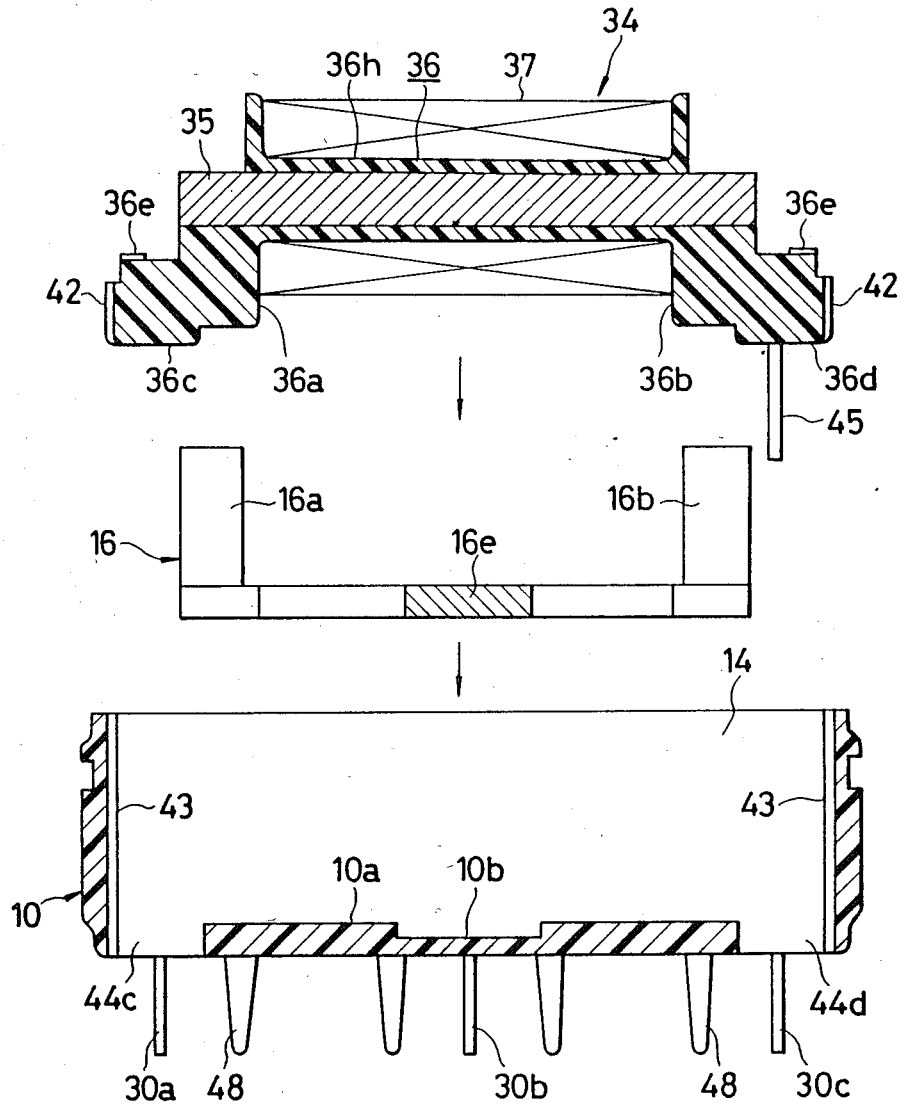
FIG. 6 is a side view showing a box-like base, a holder frame and an electromagnet of the electromagnetic relay in a disassembled state.
Figure 7:
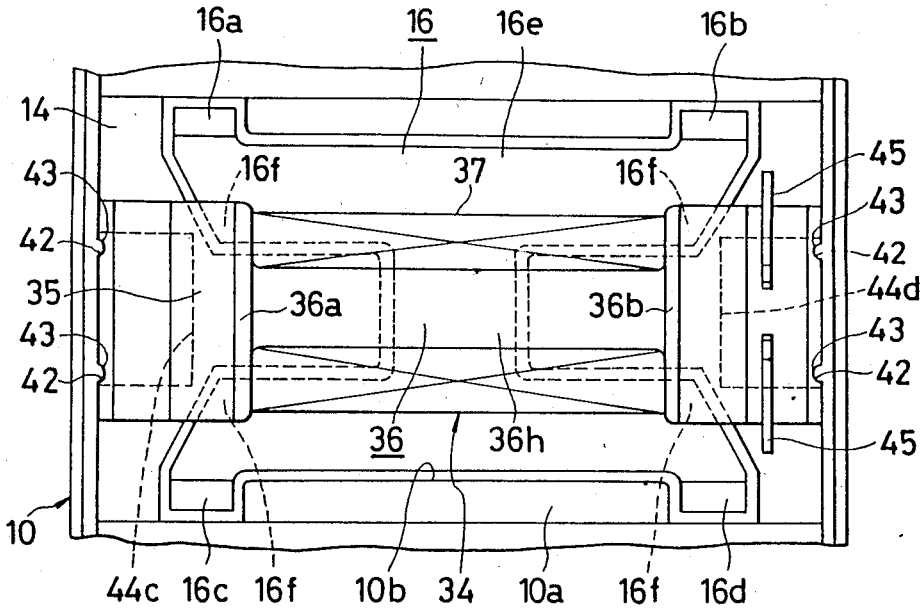
FIG. 7 is a top plan view showing the same in the assembled state.

Referring to FIG. 4, the electromagnet 34 is disposed within the middle recess 14 formed in the box-like base 14. It will thus be noted that both the contact mechanisms 40 and 41 described above are positioned at both sides of the electromagnet 34. Referring to FIG. 6, there are shown the base 10, the holder frame 16 and the electromagnet 34 in the disassembled state. For assemblying these components, the holder frame 16 is first disposed on the bottom 10*a* of the recess 14 formed in the base 10. Subsequently, the electromagnet 34 is fitted within the recess 14 of the box-like base 10. The subassembled state is shown in FIG. 7 in a top plan view. As will be seen from FIG. 7, the end collars 36*a* and 36*b* of the spool 36 on which the coil 37 is wound are positioned on the base portion 16*e* of the H-like frame 16 at four locations 16*f*. Further, when the electromagnet 34 is fitted within the recess 14, projection 43 formed in the opposite walls of the recess 14 are press-fitted in pairs of vertical grooves 42 formed in the end collars 36*a* and 36*b* of the spool 36, respectively, as is shown in FIG. 7. In the manner, the holder frame 16 is provisionally secured onto the bottom 10*a* of the box-like base 10 under pressure exerted by both collars 36*a* and 36*b* of the spool 36 to the base portion 16*e* of the H-like frame 16 at the four inner locations 16*f*, while the electromagnet 34 is simultaneously positioned to the box-like base 10. Referring to FIG. 6, downwardly offset portions or protrusions 36*c* and 36*d* are formed integrally with the end collars 36*a* and 36*b* of the spool 36, respectively. Upon placing the electromagnet 34 within the recess 14, these protrusions 36*c* and 36*d* are, respectively, fitted within through-holes 44*c* and 44*d* formed in the bottom 10*a* of the box-like base 10 (FIG. 6) so that a coil terminal pin 45 mounted on the one collar 36*b* projects downwardly beyond the bottom 10*a* of the base 10.

Referring to FIG. 7, the horizontal position of the holder frame 16 relative to the contact mechanisms 40 and 41 (FIG. 4) is so adjusted that these contact mechanisms can operate with proper contacting pressure. Subsequently, the through-holes 44*c* and 44*d* (FIG. 6) formed in the bottom 10*a* of the box-like base 10 are filled with a bonding agent 46, as is shown in the FIG. 8. A part of the bonding agent 46 can reach the four inner locations 16*f* (FIG. 7) of the base portion 16*e* of the H-like holder frame 16 through capillary action. As the consequence, the base 10, the H-like holder frame 16 and the electromagnet 34 are fixedly secured together by the bonding agent 46.

Referring to FIGS. 3 and 7, a concave portion 10*b* is formed in the bottom 10*a* of the base 10 at a location where the base portion 16*e* of the H-like frame 16 is to be positioned. As the result, upon placing of the H-like holder frame 16 within the box-like base 10, the position of the holder frame 16 is preparatorily roughly indexed by the concave portion 10*b* of the corresponding form.

Figure 8:
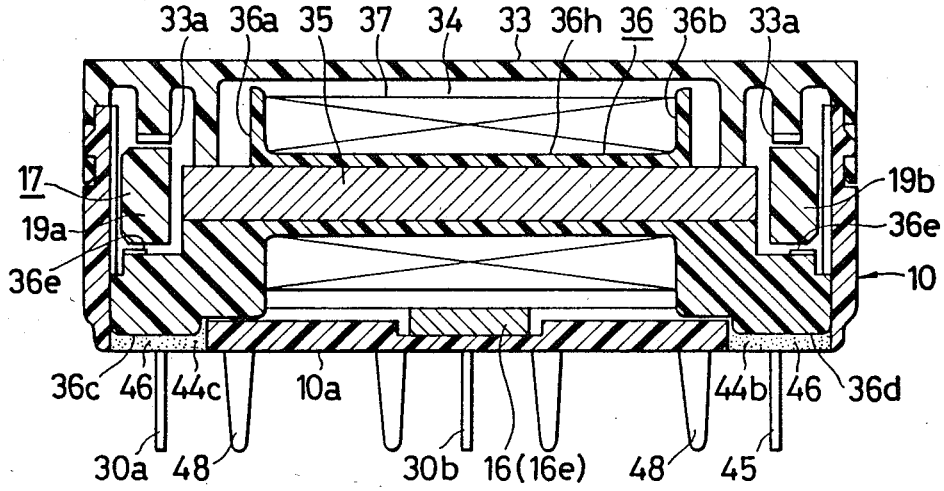
FIG. 8 is a sectional view of the electromagnetic relay taken along the line 8—8 in FIG. 4.

Referring to FIG. 4, it will be seen that the pair of permanent magnets 18*a* and 18*b* constituting parts of the movable armature frame member 17 are so disposed that the magnetic poles thereof can bear against four end faces 35*a*, 35*b*, 35*c* and 35*d* of the I-like iron core 35, respectively. In other words, the two legs of the I-like core 35 are disposed between the pair of the permanent magnets 18*a* and 18*b* in such a manner in which the axes of the legs of the former extend perpendicularly to the longitudinal axes of the latter. More specifically, the permanent magnet 18*a* is disposed movably to and from the end faces 35*a* and 35*b* of the I-like core 35, while the permanent magnet 18*b* is disposed movably to and from the end faces 35*c* and 35*d* of the iron core 35. Further, the upstanding or erect legs 16*a* and 16*b* of the H-like frame of support 16 stand in opposition to the end faces 35*a* and 35*b* of the I-like core 35, respectively, with the permanent magnet 18*a* being interposed therebetween. On the other hand, the upstanding legs 16*c* and 16*d* of the H-like support 16 are positioned in opposition to the end faces 35*c* and 35*d* of the core 35, respectively, with the permanent magnet 18*b* being interposed therebetween. The connecting members 19*a* and 19*b* of the movable armature frame member 17 are disposed on a plurality of protrusions 36*e* formed in the end collars 36*a* and 36*b* of the spool 36 (refer to FIGS. 3 and 8) so as to be axially slideable in either direction, as indicated by arrows A and B in FIG. 4. The movement or displacement of the armature frame member 17 in the direction perpendicular to the sliding movement mentioned above (i.e. the movement to the left and right as viewed in FIG. 4) is limited by pairs of protrusions 43 formed in the inner side walls of the box-like base 10. Additionally, the undesirable upward movement or floating of the movable armature frame member 17 including the permanent magnets 19*a* and 19*b* is positively prevented by projections 33*a* depending from the inner top surface of the cover 33, as is seen in FIG. 8.

Figure 9:
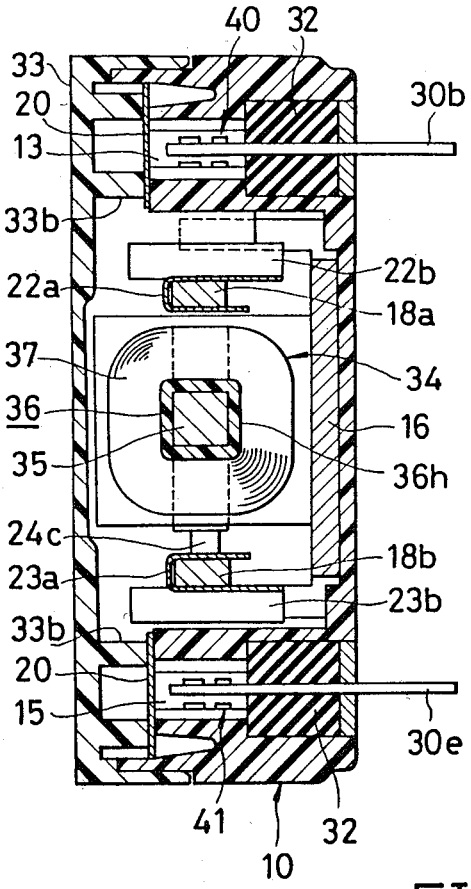
FIG. 9 is a sectional view taken along the line 9—9 in FIG. 4.

The clamping portions 22*a* and 23*a* of the actuating members 22 and 23 (FIG. 3) are, respectively, fixedly mounted on the permanent magnets 18*a* and 18*b* at middle portions thereof, as shown in FIGS. 4 and 9. Referring to FIG. 4, free end portions of the cards 25 and 26 are engaged with the E-like latching members 22*b* and 22*c* of the actuating member 22 in an interdigital manner, while free end portions of the cards 27 and 28 disposed at the opposite side are similarly engaged with the latching members 23*b* and 23*c* of the other actuating member 23. Further, the free ends of the restoring springs 24*c* and 24*d* projecting laterally from the clamping portion 23*a* of the actuating member 23 are caused to bear on the end faces 35*c* and 35*d*, respectively, of the I-like core 35 under resilient pressure, as is shown in FIG. 4.

Figure 10:
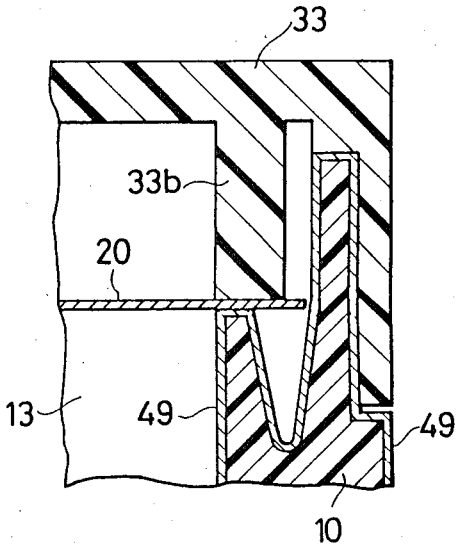
FIG. 10 is a fragmental sectional view showing a shielding structure of the electromagnetic relay.

Again referring to FIG. 4, there are formed in the recesses 13 and 15 of the box-like base 10 projections or protrusions 47 with which the movable contact members 29*a*, 29*b*, 29*c* and 29*d* are, respectively, brought into contact when they are moved away from the respective stationary contact 30*a* to 30*f*. These protrusions 47 constitute stationary earth contacts electrically connected to the ground, as will be described hereinafter. In this connection, the bottom 10*a* of the base 10 may be integrally provided with depending projections 48 between external connection pins 31 for the stationary contact members 30*a* to 30*f* (refer to FIG. 5), which projections 48 may be used as the earth terminals for the connection to the ground. As is partially illustrated in FIG. 10, the whole surface of the base 10 inclusive of the surfaces of the recesses 13, 14 and 15 (FIG. 4) and the earth projections 48 for the grounding connection is covered with an electrically conductive layer 49 formed through plating, evaporation or coating. Referring to FIGS. 5, and 9, the recesses 13 and 15 of the box-like base 10 are covered by the shielding plates 20 and 20' which are electrically contacted to the electrically conductive layer 49 (FIG. 10) along the peripheral edges of the recesses 13 and 15 under pressure exerted by the depending projections 33 formed in the inner top surface of the cover 33.

Next, description will be made on operation of the electromagnetic relay having the structure described above. Referring to FIG. 4, it is initially assumed that the coil 37 is energized in such a direction in which the I-like core 35 is so magnetized that the magnetic poles of the same polarities as those of the magnetic poles produced at both ends of the permanent magnet 18*a* make appearance, respectively, at the end faces 35*a* and 35*b* of the I-like core 35, while the end faces 35*c* and 35*d* of the core 35 are magnetized in the magnetic polarities differing from those produced at both ends of the permanent magnet 18*b*. On the conditions, a repulsing or repelling force is produced between the end faces 35*a* and 35*b* and the permanent magnet 18*a* while an attracting force acts between the faces 35*c* and 35*d* and the other permanent magnet 18*b*. As the consequence, the movable armature frame body 17 is caused to move in the direction indicated by the arrow B against the spring force exerted by the restoring leaf springs 24*c* and 24*d* (FIG. 3 and FIG. 4). At that time, the cards 25, 26 and 27, 28 are driven also in the same direction A by means of the actuating members 22 and 23 carried by the movable frame 17, resulting in that the movable contact member 29*a* is detached from the associated stationary contacts 30*a* and 30*b* while the movable contact member or arm 29*b* is brought into contact with the stationary contact members 30*b* and 30*c*. On the other hand, the movable contact arm 29*c* bears on the stationary contact members 30*d* and 30*e* while the movable contact arm 29*d* comes into contact with the stationary contact members 30*e* and 30*f*. In this way, the current path between the stationary contact members 30*a* and 30*b* as well as the stationary contacts 30*e* and 30*f* are interrupted or opened, while the current path is established or closed between the stationary contacts 30*b* and 30*c* as well as between the stationary contact members 30*d* and 30*e*.

Upon electrical deenergization of the coil 37, the movable frame 17 is driven in the direction indicated by the arrow B under the influence of the restoring springs 24*c* and 24*d*, resulting in that the permanent magnet 18*a* is attracted to the end faces 35*a* and 35*b* of the I-like core 35. Consequently, the movable contact members or arms 29*a*, 29*b*, 29*c* and 29*d* are restored to the state shown in FIG. 4, wherein the current path is established between the stationary contact members 30*a* and 30*b* and between the stationary contacts 30*e* and 30*f*, while the current path is interrupted or opened between the stationary contacts 30*b* and 30*c* as well as between 30*d* and 30*e*.

In the operations described above, the movable contact members 29*a*, 29*b*, 29*c* and 29*d* disposed within the recesses 13 and 15 of the box-like base 10 are caused to bear on the respective earth portions 47 upon being detached from the respective stationary contacts denoted generally by 30. In this connection, it is to be noted that the surfaces of these projections or protrusions 47 are coated with the electrically conductive layer 49 as described hereinbefore by referring to FIG. 10, and that the interiors of the recesses 13 and 15 of the base 10 are shielded through cooperation of the electrically conductive layer 49 and the shielding plates 20 and 20'. Accordingly, there is no possibility of formation of high-frequency short circuits between the opened stationary contacts 30 due to electrostatic coupling which would otherwise be formed by way of the movable contact members or arms 29 when they are detached from the stationary contacts 30. Further, the projections 48 depending from the bottom of the box-like base 10 (refer to FIG. 5) serve to prevent a high-frequency current from flowing between the adjacent leads or pins 31 of the stationary contacts 30.

Since the restoring springs 24*c* and 24*d* (FIG. 4) are made of a non-magnetic material and have free ends disposed between the permanent magnet 18*b* and the end faces 35*c* and 35*d*, respectively, of the I-like iron core 35, the permanent magnet 18*b* is forced to bear on faces 35*c* and 35*d* of the I-like core 35 with the non-magnetic restoring springs 24*c* and 24*d* being interposed as elastically deformed between the permanent magnet 18*b* and the I-like core 35, when the movable armature frame body 17 is driven in the direction indicated by the arrow A shown in FIG. 4. Consequently, when the movable armature frame body 17 is driven backward in the direction of the arrow B in response to deenergization of the coil 37, the magnetic attracting force of the permanent magnet 18*b* exerted to the I-like core 35 is reduced by the elastic restoring force of the springs 24*c* and 24*d*, whereby the restoring operation of the movable frame body can take place very rapidly. As is apparent from FIG. 4, in the electrically deenergized state of the coil 37, the permanent magnet 18*b* detached from the end faces 35*c* and 35*d* of the I-like iron core 35 is attracted to the upstanding legs 16*c* and 16*d* of the H-like support 16. On the contrary, the movable armature frame body 17 is driven in the direction indicated by the arrow A. The other permanent magnet 18*a* is attracted to the other legs 16*a* and 16*b*. In this way, the natural demagnetization of the permanent magnets 18*a* and 18*b* is positively inhibited.

Figure 11:
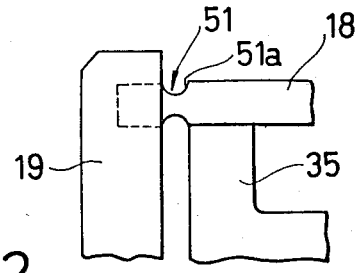
FIG. 11 is a fragmental plan view of the armature frame used in the electromagnetic relay.

FIG. 11 is a partially enlarged view showing the connection of the permanent magnet 18 and the connecting member. Referring to FIG. 11, the permanent magnet 18 is formed with annular notches 51 having edges 51*a* adjacent to the end of the magnet 18. In other words, the permanent magnet 18 is reduced in thickness at these portions 51. This notch or groove 51 serves to accommodate a quantity in excess of the bonding agent which is used for bonding the connecting member 19 and the permanent magnet 18. Additionally, the notch 51 provides other advantageous effects mentioned below. In general, the magnetic flux produced by a permanent or electromagnet is not emitted from the intermediate portion of the magnet but from the end faces. In this conjunction, it is noted that the end portion of the permanent magnet 18 of the movable armature frame 17 is embedded in the connecting member 19 and useless for this purpose. Under the circumstance, the invention teaches that the annular notch or groove 51 be provided in the vicinity of the end portion of the permanent magnet which is embedded or anchored in the connecting member 19, to thereby allow the magnetic flux to be emitted from the edges 51*a* of the annular groove 51 for more effective utilization of the magnetism provided by the permanent magnet 18.

By the way, realization of the restoring springs 24*c* and 24*d* and the actuating member 23 in an integral structure as shown in FIGS. 3 and 4 is advantageous in that the number of components can be correspondingly decreased, which in turn contributes to reduction in the manufacturing cost.

Figure 12:
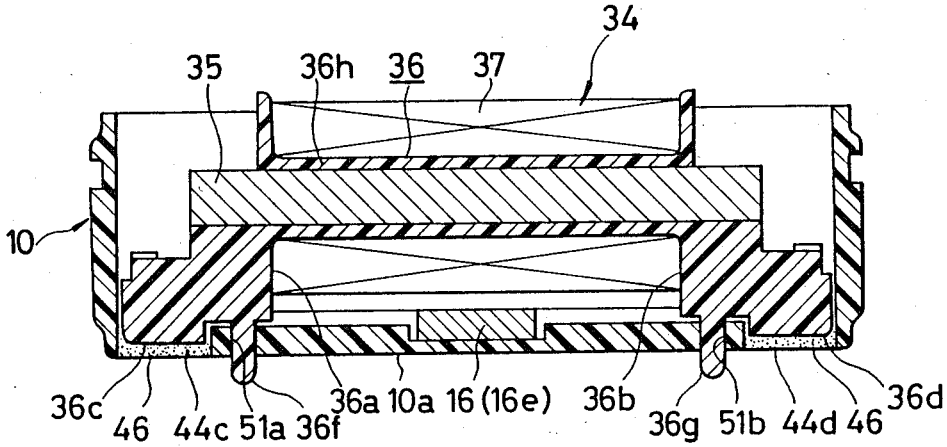
FIG. 12 is a sectional view showing a version of the electromagnetic relay.

FIG. 12 shows an electromagnetic relay according to a version of the aforementioned embodiment of the present invention. In the case of the instant embodiment, projections 36*f* and 36*g* are integrally formed in the end collars 36*a* and 36*b* of the spool 36 at the bottom thereof and project downwardly. These projections 36*f* and 36*g* are press-fitted into through-holes 51*a* and 51*b* formed in the bottom wall of the box-like base 10, whereby the base portion 16*e* of the H-like support 16 is provisionally secured onto the bottom 10*a* of the box-like base 10 between the end collars 36*a* and 36*b* of the spool 36. The lower ends of the projections 36*f* and 36*g* projecting downwardly beyond the bottom 10*a* are thermally rivetted to the lower surface of the bottom 10*a* of the base 10. Subsequently, the positional adjustment of the H-like support 16 is effected, which is followed by the injection of the bonding agent 46, as described hereinbefore in conjunction with the preceding embodiment.

The thermal rivetting of the projections 36*f* and 36*g* described above is preferable for properly fixing the H-like frame or support 16 by means of the spool 36 in case the projections 36*f* and 36*g* are only loosely inserted into the through-holes 51*a* and 51*b* due to tolerance in fabrication. The projections 36*f* and 36*g* for the thermal rivetting may, of course, be additionally employed in the structure where the provisional fixing of the H-like support 16 is effected through engagement between the projections 43 and the vertical grooves 42 as shown in FIGS. 6 and 7.

Figure 13:
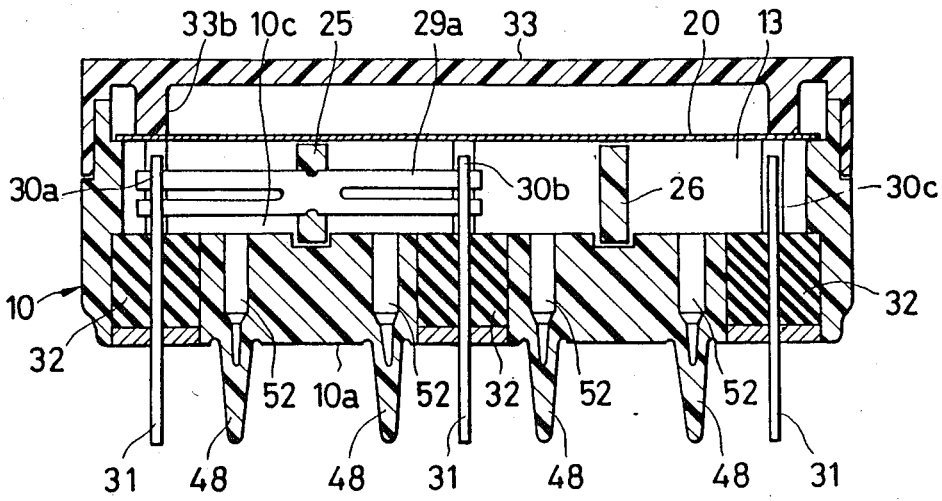
FIG. 13 is a fragmental sectional view of the box-like base showing a structure and arrangement of earth terminals which may be used in the electromagnetic relay according to the invention.
Figure 14:
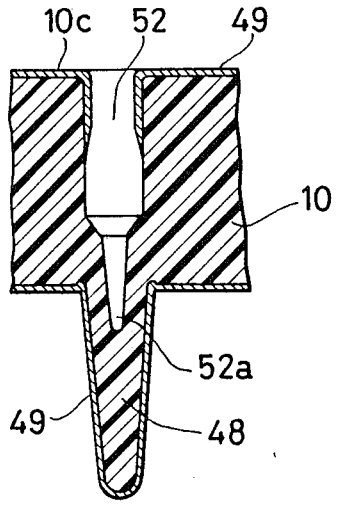
FIG. 14 is a partial enlarged view of FIG. 13.

Referring to FIGS. 13 and 14 which show another vertion of the embodiments described above, a bore 52 is formed in each of the depending projections 48 serving for connection to the ground and opened in the inner surface 10*c* of the base 10. These bores 52 are effective for accommodating expansion of resin material of the projections 48 or collecting resin material fluidified under heating for soldering lead wires (not shown) to the surface of the projection 48.

The bore 52 extends to considerable depth from the inner surface 10*c* of the bottom of the base 10 and has an end 52*a* terminated at a point distanced considerably from the inner surface 10*c*. Accordingly, upon deposition of the electrically conductive layer 49, the pointed end portion 52*a* of the bore 52 remains uncovered, thus assuring the function of the bore 52 mentioned above.

When the earth projection 48 for connection to the ground is formed as to be tapered from the foot to the free end, the bore 52 can be realized in a correspondingly increased diameter, as is illustrated in FIG. 14.

In the case of the embodiments described above, the recesses 13 and 15 formed in the box-like base 10 for containing the contact mechanisms or relay switches, respectively, are closed by the respective shielding plates 20 and 20'. As the alternative, these recesses 13 and 15 may be shielded or closed by the cover 33 itself which is then coated with the electrically conductive film over the whole surface.

Next, description will be made of another exemplary embodiment of the invention shown in FIGS. 15 to 20. This embodiment is directed to an improvement of the electromagnetic relay which is adapted to turn on one of two circuits while turning off the other. This electromagnetic relay cerresponds to the fourth preferred embodiment aforementioned in conjunction with the summary of the invention.

Generally, in an electromagnetic relay which includes a common contact member, a normally closed stationary contact member and a normally opened stationary contact member which are disposed in opposition to each other with the common contact member being interposed therebetween, and a normally closed movable contact arm and a normally opened movable contact arm which establish mutually opposite electric states between the common contact member and the normally closed stationary contact member on one hand and between the common contact member and the normally opened stationary contact member on the other hand, the distance between the common contact member and the normally opened stationary member has to be reduced in order to increase the contacting pressure of the normally opened movable contact arm for a given stroke. This arrangement, however, brings about degradation in respect with electrostatic isolation, to a disadvantage.

With the structure of the electromagnetic relay according to the instant embodiment, it is intended to eliminate the drawback mentioned above and allow the contacting pressure of the normally opened movable contact arm to be increased without need for reduction of the distance between the common contact member and the normally opened stationary contact member.

Figure 15:
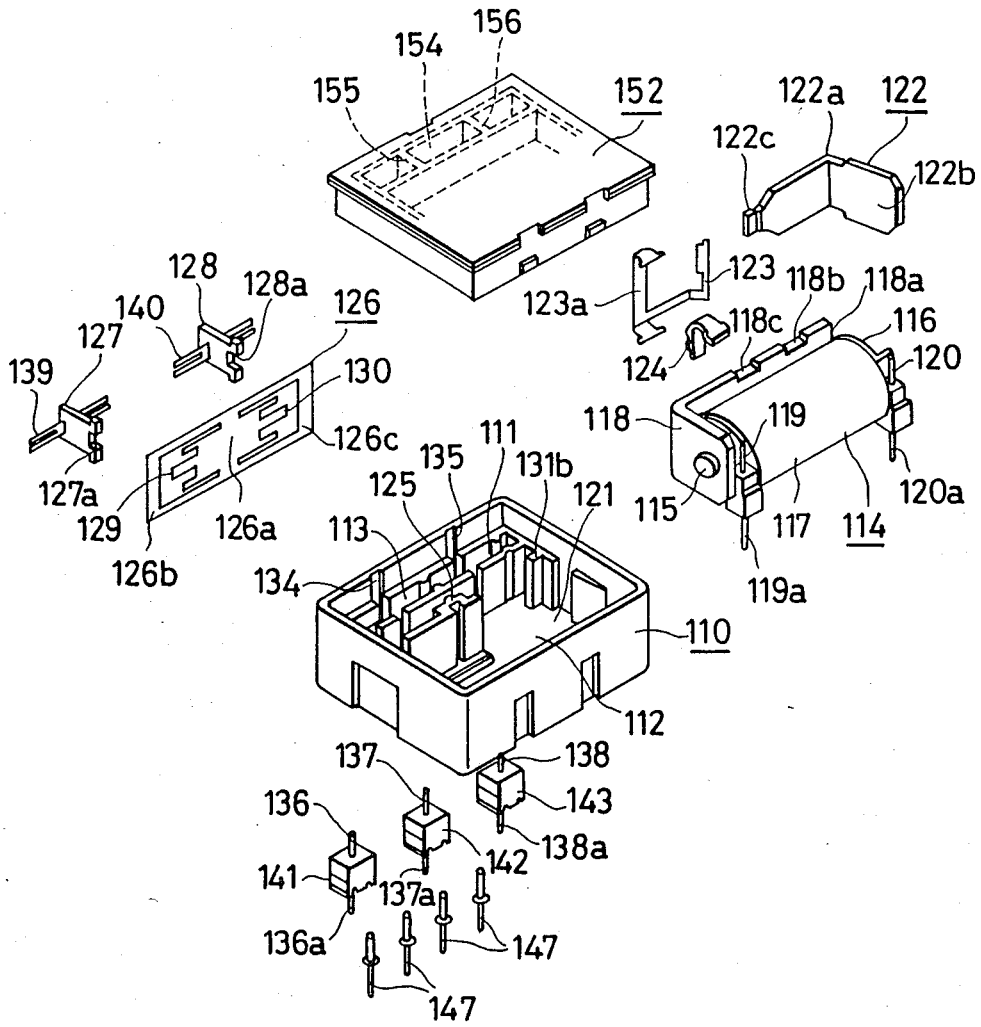
FIG. 15 is an exploded perspective view showing an electromagnetic relay according to another embodiment of the present invention.
Figure 20:
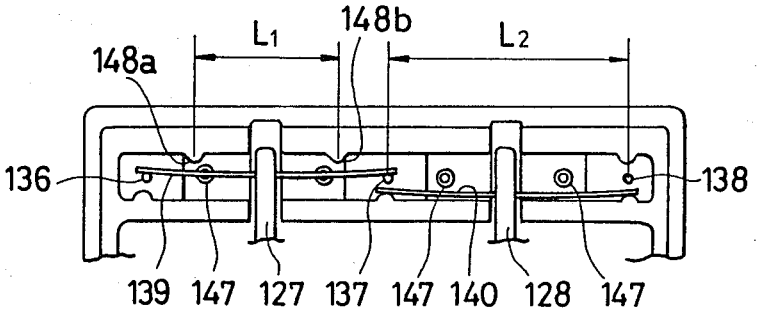
FIG. 20 is a plan view of contact mechanisms of the electromagnetic relay shown in FIG. 15 and illustrates a feature of the present invention realized in the relay.

Now, referring to FIGS. 15 and 20, a numeral 110 denotes a box-like base which is made of a moldable resin and has two interior compartments or recesses 112 and 113 and a partitioned wall 111. The recess 112 is adapted to accommodate therein an electromagnet 114 which is composed of a core 115, a coil 117 wound around a molded spool 116 of a resin material in which the core 115 is inserted, and an L-like yoke 118 having one end 115*a* (FIG. 16) fixed to one end of the core 115. The spool 116 has a pair of end collars 116*a* and 116*b* provided with coil terminal pins 119 and 120 for connection of the lead wires of the coil. The terminal pins 119 and 120 have respective lower projections 119*a* and 120*a* which project downwardly beyond the bottom 121 of the box-like base 110. A numeral 122 denotes an L-like movable armature member having a corner portion 122*a* at which the L-like armature member 122 is swingably held at the free end portion 118*a* of the yoke 118 under pressure exerted by a hinge spring 123. The latter has a base portion 123*a* which is shaped so as to engage in notches 118*b* formed in upper and lower edges of the yoked 118. In FIG. 15, only the upper notch 118*b* is shown. A numeral 124 denotes an L-like yoke fixing member having one leg fixedly engaged in a notch 118*c* formed in the upper edge of the yoke 118*c* and the other leg 124 which is press-fitted in a longitudinal groove 125 formed in the box-like base 110.

Figure 16:
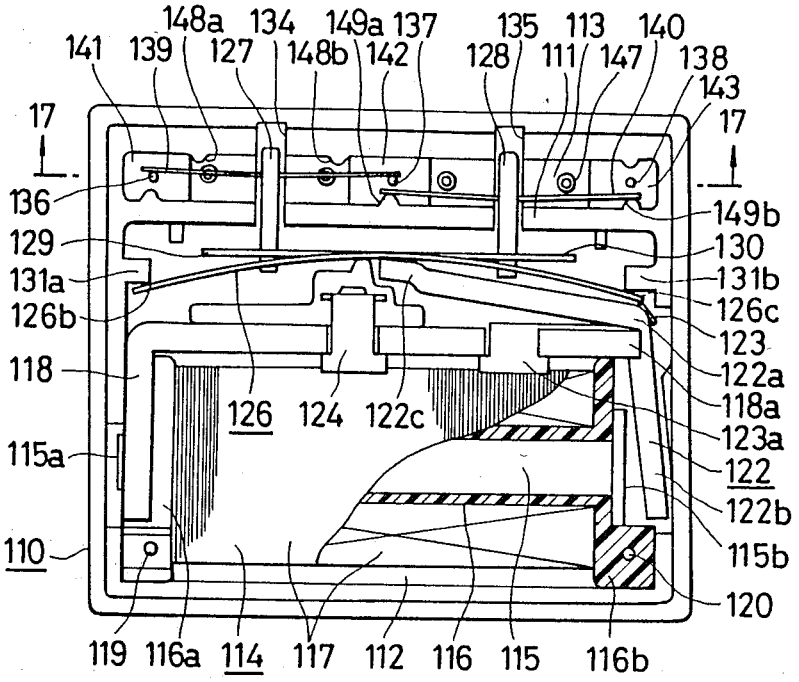
FIG. 16 is a partially broken top plan view showing the assembled state of the electromagnetic relay shown in FIG. 15.

A reference numeral 126 generally denotes a restoring spring which has a center portion 126*a* pressed by one end 122*c* of the swingable armature 122 when the other end 122*b* of the armature 115 is attracted to the other end 115*b* of the core 115. The restoring spring 126 is generally of a rectangular frame-like configuration and has a pair of lateral actuating members 129 and 130 integrally formed through punching and destined to transmit the movement of the armature member 122 to cards 127 and 128, respectively. The rectangular restoring spring 126 is held in the base 110 at both end portions 126*b* and 126*c* which abut on projections 131*a* and 131*b* formed in inner side walls of the box-like base 10, as is shown in FIG. 16. The cards 127 and 128 have respective latch end portions 127*a* and 128*a* which are engaged with the actuating leaves 129 and 130, respectively, as will be seen from FIG. 15.

Figure 17:
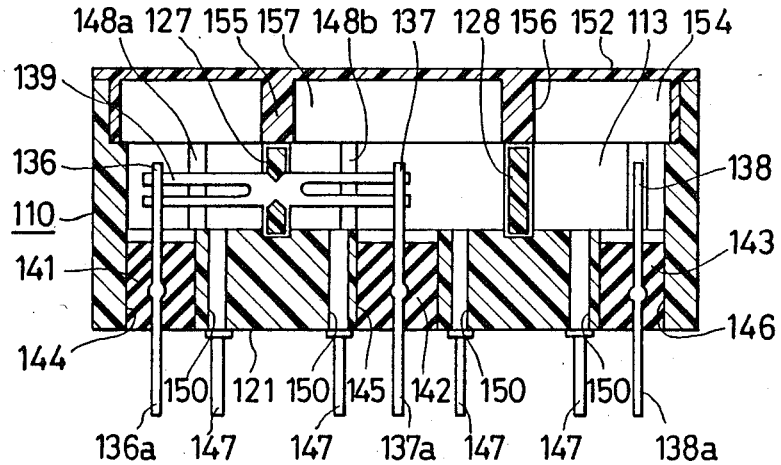
FIG. 17 is a sectional view of the same taken along the line 17—17 in FIG. 16.

The cards 127 and 128 are slideably disposed in grooves 134 and 135, respectively, which are formed in the box-like base 110 and extend transversely of the recess 113. The one card 127 supports the normally closed movable contact arm 139 at a middle portion thereof. The contact arm 139 serves to selectively close or open the current path between the normally closed stationary contact 136 and the common contact member 137. The other card-like member 128 fixedly supports the normally opened movable contact arm 140 at a center portion thereof. The contact arm 140 serves to selectively establish or interrupt the current path between the other normally opened stationary contact 138 and the common contact member 137. The normally closed stationary contact member 136 and the normally opened stationary contact member 138 are disposed in opposition to each other symmetrically relative to the interposed common contact member 137. The contact members 136, 137 and 138 are fixedly supported by dielectric blocks 141, 142 and 143, respectively, which in turn are snugly fitted in openings 144, 145 and 146, respectively, formed in the bottom wall 121 of the box-like base 110, as is shown in FIG. 17. With a view to preventing a high-frequency current from flowing between lead pins 136*a* and 137*a* as well as between lead pins 137*a* and 138*a* of the contact members 136, 137 and 138 extending downwardly from the dielectric blocks 141, 142 and 143, respectively, earthing terminal pins 147 for connection to the ground are fixedly secured in four through-holes 150, respectively, which are formed in the bottom walls 121 of the base 110 at positions between the lead pins 136*a* and 137*a* and between the lead pins 137*a* and 138*a*. The through-holes 150 are coated with an electrically conductive layer described hereinafter.

Figure 18:
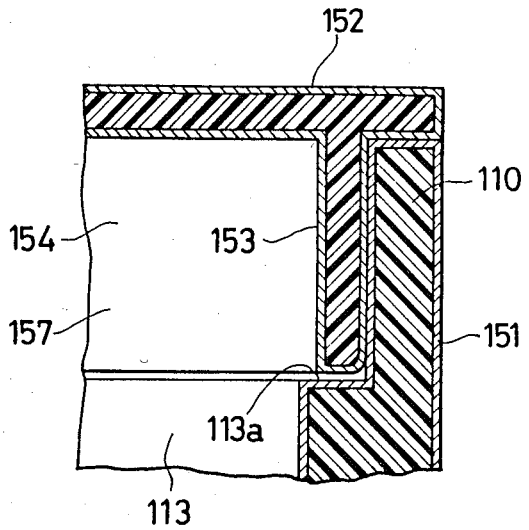
FIG. 18 is a fragmental sectional view showing a shielding structure of a casing for the electromagnetic relay shown in FIGS. 15 and 16.
Figure 19:
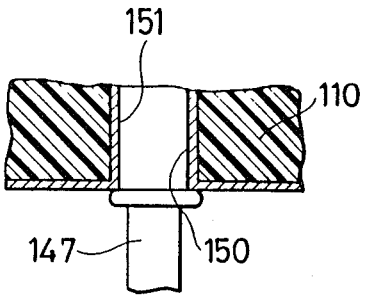
FIG. 19 is a fragmental enlarged view showing an electrically conductive layer deposited on an inner surface of a through-hole for mounting an earth terminal used in the electromagnetic relay shown in FIG. 15.

There are formed in the box-like base 110 within the recess 113 a pair earthing protrusions 148*a* and 148*b* for connection to the ground with ehich the normally closed movable contact arm 139 is brought into contact when it is detached from the contact members 136 and 137 and another pair of earthing protrusions 149*a* and 149*b* with which the other normally opened movable contact arm 140 comes to contact upon being detached from the contact members 137 and 138. The whole surface of the base 10 inclusive of the inner walls of the recesses 112 and 113 and the through-holes 150 for mounting the earth terminal pins is covered with an electrically conductive layer 151 through plating, evaporation or coating, as is shown in FIGS. 18 and 19. A cover 152 for closing the open end of the box-like base 110 is formed of a resin through molding and has the surface coated with an electrically conductive layer 153 which is electrically connected to the conductive layer 151 of the base 110 when the cover 152 is put on the base 110. In this way, the base 110 cooperates with the cover 152 to constitute a shielded case. The inner top wall of the cover 152 has a recess 154 formed therein at a position opposite to recess 113 formed in the box-like base 110. There are provided beam members 155 and 156 (FIG. 17) serving for preventing the cards 127 and 128 from jumping upward.

In operation, when the coil 117 (FIG. 16) is electrically energized, the one leg portion 122*b* of the L-like movable armature member 122 is magnetically attracted to the pole end 115*b* of the core 115. More specifically, the L-like armature member 122 is rotated about the axis located at the corner 122*a*, whereby the restoring spring 126 is pressed at the intermediate portion 126*a* (FIG. 15) by means of the leg 122*c* of the L-like armature member 122. Thus, the actuating pieces 129 and 130 urge the cards 127 and 128 to move forwardly (to the upper side as viewed in FIG. 16) in parallel with each other, as the result of which the normally closed movable contact arm 139 is detached from the contact members 136 and 137 while the normally opened movable contact arm 140 is caused to bear on the contact members 137 and 138. Consequently, the current path between the contact members 136 and 137 is interrupted, while the current path is established between the contact members 137 and 138. Upon deenergization of the coil 117, the spring 126 tends to restore the original state, whereby the leg 122*b* of the movable armature member 122 is detached from the end portion 115*b* of the core 115 while the cards 127 and 128 are retracted by means of the actuating pieces 129 and 130, resulting in that the normally movable contact arm 140 is detached from the contact members 137 and 138 with the normally closed movable contact arm 139 in turn being pressed against the contact members 136 and 137. Consequently, the current path is interrupted between the contact members 137 and 138, while the current path is established between the contact members 136 and 137.

In the course of operation described above, the normally closed movable contact arm 139 bears on the earth protrusions 148*a* and 148*b* provided in the recess 113 when the former is detached from the contacts 136 and 137. On the other hand, the normally opened movable contact arm 140 bears on the earth protrusions 149*a* and 149*b* upon detachment from the contact members 137 and 138. The surfaces of these protrusions 148*a*, 148*b* and 149*a*, 149*b* are coated with the electrically conductive layer 151 (FIG. 15) which cooperates with the electrically conductive layer 153 formed over the surface of the cover 152 to electrically shield the space 157 (FIGS. 17 and 18) defined by the recess 113 of the base 110 containing the contact members 139, 140 and 136, 137 and 138 and the recess 154 formed in the cover 152. Accordingly, there is no possibility of the high-frequency short-circuit being produced through the electrostatic coupling between the electrically conductive layer 151 and the contact members 136 and 137 and between the layer 151 and the contact members 137 and 138 upon the detachment of the movable contact members 139 and 140, respectively.

Although the electrically conductive layer or film 153 is formed on the whole surface of the cover 152 in the case of the illustrated embodiment, it will be readily appreciated that the film 153 may be formed only over that portion of the surface which corresponds to the contact-mechanism accomodating space 157. Alternatively, in place of providing the electrically conductive layer 153, a shielding plate (not shown) may be disposed on a peripheral offset portion 113*a* (FIG. 18) of the recess 113 so as to close the top opening thereof. This shield plate is then pressed against the offset portion 113*a* by means of the cover 152 so that the shield plate is electrically connected to the electrically conductive layer 151 at the offset portion 113*a*.

Referring to FIG. 20, the distance $L_1$ between the earth protrusions 148*a* and 148*b* on which the normally closed movable contact arm 139 bears upon opening operation is selected smaller than the distance $L_2$ between the common contact member 137 and the normally opened contact member 138. In this connection, it should be noted that the dimension $L_1$ has heretofore been selected equal to $L_2$.

With the structure of the electromagnetic relay described above, the degree of deformation of the normally closed movable contact arm 139 produced when the latter is pressed against the earth protrusions 148*a* and 148*b* can be made smaller as compared with the known structure where $L_1$ equals $L_2$. This means that the normally closed movable contact arm 139 is caused to bear against the earth protrusions 148*a* and 148*b* with a correspondingly increased force. In that case, since the normally opened movable contact arm 140 is caused to move concurrently in the same stroke as that of the normally closed contact arm 139 under the action of the restoring spring 126 (FIG. 16), the normally opened movable contact arm 140 is subjected to essentially the same contact pressure as the normally closed movable contact arm 139. In other words, the normally opened movable contact arm 140 also is caused to press against the common contact member 137 as well as the normally opened contact member 138 with an increased contacting pressure. In this way, the contacting pressure of the normally opened movable contact arm 140 can be increased without decreasing the distance $L_2$ between the common contact member 137 and the normally closed contact member 138, i.e. without involving degradation in electrical isolation by positioning the contact pin members 137*a* and 138*a* closer to the electrically conductive layer 150 (FIG. 19) of the pins 147 for connection to the ground.

In the foregoing, the invention has been described in conjunction with the exemplary embodiments illustrated in the drawings. It should however be appreciated that many modifications and variations will readily occur to those skilled in the art without departing from the spirit and scope of the invention. Accordingly, the present invention is never restricted to the disclosure herein.

What is claimed is:

1. An electromagnetic relay comprising:

an electromagnet composed of a core and a coil wound around said core;

at least a contact mechanism disposed at a side of said electromagnet;

a movable armature composed of at least a permanent magnet juxtaposed in parallel with said electromagnet so that both magnetic poles of said permanent magnet are positioned in opposition to both ends of said core, respectively;

a holder frame having erect legs positioned adjacent to both ends of said core, respectively, with said permanent magnet being interposed between said legs and said core;

an actuating member operatively coupled to said permanent magnet for actuating said contact mechanism;

a restoring spring for said movable armature disposed between said permanent magnet and said core;

wherein said core is of an I-like configuration and pairs of relay swithces are disposed at both sides of said electromagnet, respectively, with a first pair of said relay switches being positioned adjacent to one end of said core while a second pair of the relay switches is positioned adjacent to the other end of said core, said movable armature being of a rectangular frame structure constituted by a pair of the permanent magnets extending in parallel with said core, disposed at both sides thereof, respectively, and interconnected by non-magnetic connecting beams, wherein said pair of permanent magnets are so disposed that magnetic poles of opposite polarities face toward one another; and wherein said holder frame is of an H-like form having four upstanding legs of which two are disposed at one side of said electromagnet with one of said permanent magnets being interposed therebetween while the other two legs are disposed at the other side of the electromagnet with the other permanent magnet being disposed therebetween.

2. An electromagnetic relay according to claim 1, wherein the pair of said relay switches disposed at each side of said electromagnet is so arranged that when one of said relay switches is closed the other is simultaneously opened.

3. An electromagnetic relay according to claim 2, wherein each of said relay switch is composed of a movable contact member supported on a card-like member operatively coupled to said permanent magnet by way of said actuating member and a pair of stationary contacts to be electrically connected and disconnected by said movable contact member.

4. An electromagnetic relay according to claim 3, wherein the pair of said relay switches disposed at each side of said electromagnet have one of said stationary contacts in common to both relay switches.

5. An electromagnetic relay according to claim 3, wherein when said movable contact arm is detached from said respective stationary contacts, said movable contact arm is brought into contact with earth contacts.

6. An electromagnetic relay according to claim 1, wherein notches are formed in said permanent magnet at positions adjacent to the end portions of said permanent magnet at which said permanent magnet is connected to said connecting beam member.

7. An electromagnetic relay according to claim 1, wherein said restoring spring is made of a non-megnetic material and disposed between lateral end faces of said I-like core and one of said permanent magnet.

8. An electromagnetic relay according to claim 1, wherein said restoring spring is formed integrally with one of said actuating members.

9. An electromagnetic relay according to claim 1, wherein said spool is provided with a pair of end collars, said base being formed with apertures at locations where said collars are positioned when said electromagnet is mounted on said base with said holder frame being interposed therebetween, said apertures being filled with a bonding agent for thereby fixing together said end collars of said spool, said base and said holder frame.

10. An electromagnetic relay according to claim 1, wherein said base for mounting therein said relay switches is formed of a synthetic material with earth projections projecting integrally and outwardly from said base, the surface of said base inclusive of that of said earth projections being covered with an electrically conductive layer, further including bores each extending longitudinally in each of said earth projections from the inner surface of said base.

11. An electromagnetic relay, comprising:

a common contact member;

a normally closed contact member;

a normally opened contact member provided in opposition to said normally closed contact member with said common contact member being interposed therebetween;

a normally closed movable contact piece mounted on a card at an intermediate portion and serving for opening or closing a current path between said common contact member and said normally closed member;

a normally opened movable contact piece mounted on a card at an intermediate portion and serving for closing or opening a current path between said common contact member and said normally opened contact member;

a restoring spring for resiliently urging said cards in parallel with each other to thereby hold said normally closed movable contact piece in the current path establishing state while holding said normally opened movable contact piece in the current path interrupting state;

an electromagnet for pressing said restoring spring at an intermediate portion to thereby change over said normally closed contact piece to said current path interrupting state, while changing over said normally opened movable contact piece to said current path establishing state; and a pair of earth protrusions against which at least said normally closed movable contact piece bears in said current path interrupting state; wherein;

distance between said paired earth protrusions against which said normally closed movable contact piece bears is selected smaller than a distance between said common contact member and said normally opened contact member.

* * * * *